US011419426B2

(12) United States Patent
Ohanian

(10) Patent No.: US 11,419,426 B2
(45) Date of Patent: Aug. 23, 2022

(54) PORTABLE SEAT CUSHION

(71) Applicant: Ara Ohanian, Doraville, GA (US)

(72) Inventor: Ara Ohanian, Doraville, GA (US)

( * ) Notice: Subject to any disclaimer, the term of this patent is extended or adjusted under 35 U.S.C. 154(b) by 0 days.

(21) Appl. No.: 16/875,520

(22) Filed: May 15, 2020

(65) Prior Publication Data

US 2021/0353068 A1 Nov. 18, 2021

(51) Int. Cl.

| | |
|---|---|
| ***A47C 7/46*** | (2006.01) |
| *A47C 5/12* | (2006.01) |
| *A47C 7/02* | (2006.01) |
| *A61H 7/00* | (2006.01) |
| *A61H 39/04* | (2006.01) |

(52) U.S. Cl.

CPC ..... *A47C 7/467* (2013.01); *A47C 7/462* (2013.01); *A47C 5/12* (2013.01); *A47C 7/021* (2013.01); *A47C 7/029* (2018.08); *A61H 7/007* (2013.01); *A61H 39/04* (2013.01)

(58) Field of Classification Search

CPC ..... A47C 7/46; A47C 7/462; A47C 7/467; A47C 7/021; A47C 7/029; A47C 7/425; A61H 7/007; A61H 7/008; A61H 39/04; A61H 1/0292

See application file for complete search history.

(56) References Cited

U.S. PATENT DOCUMENTS

| | | | | |
|---|---|---|---|---|
| 4,761,011 | A | 8/1988 | Sereboff | |
| 5,290,307 | A * | 3/1994 | Choy | A61H 39/04 128/101.1 |
| 5,911,657 | A | 6/1999 | Meiners | |
| 6,929,325 | B1 | 8/2005 | Goelo | |
| 8,740,303 | B2 | 6/2014 | Halliday | |
| 9,981,577 | B2 | 5/2018 | Zouzal et al. | |
| 9,987,961 | B2 | 6/2018 | Zouzal et al. | |
| 10,624,456 | B2 * | 4/2020 | Fernandez | A47C 7/425 |

FOREIGN PATENT DOCUMENTS

| | | | |
|---|---|---|---|
| GB | 2577323 | A | 3/2020 |

* cited by examiner

*Primary Examiner* — Syed A Islam
(74) *Attorney, Agent, or Firm* — Rumit Ranjit Kanakia

(57) ABSTRACT

A portable seat and back cushion for posture correction. The device includes a seat member with an inflatable bladder or a foam insert and a back member that is foldably connected to the seat member. A customizable support member is disposed within the back member. The customizable support member may include either an inflatable bladder with a plurality of individually adjustable bubbles arranged in a vertical row or a semi-rigid insert with a plurality of selectively positionable vertebral support nodules.

10 Claims, 5 Drawing Sheets

PORTABLE SEAT CUSHION

BACKGROUND

1. Field of the Invention

The present disclosure relates generally to a portable seat and back cushion for improving posture and relieving pressure concentrations of a user, and more particularly relates to a portable seat and back cushion providing support to the sacrum and the lumbar region of a user and can be used in connection with a wide variety of chairs and seats.

2. Description of the Prior Art

The use of inflatable or foam cushions is known. Conventional cushions come in familiar configurations adapted to the specific use objective of each inflatable cushion. Examples of such cushions are described in U.S. Pat. Nos. 5,911,657; 8,740,303; 6,929,325; and 4,761,011. However, conventional cushions lack portability or suitable adjustability to support individual vertebrae.

It therefore would be desirable to provide improved portable seat and back cushions that can be adjusted to provide a user with custom support of his or her vertebrae, for example, for posture correction and/or pain relief.

SUMMARY

Portable seat cushions are provided with individually customizable ergonomic support for the pelvic, lumbar, and thoracic regions.

In embodiments, the seat cushion has a seat member and a back member, which are flexibly connected together. In some embodiments, the seat member includes an inflatable bladder or a foam insert, and the back member includes a customizable support member disposed within the back member. The customizable support member may include either an inflatable bladder with a plurality of individually adjustable bubbles arranged in a vertical row about the middle of the back member or a semi-rigid insert with a plurality of selectively positionable vertebral support nodules. The inflation pressure within each vertebral support bubble may be individually adjustable. Similarly, the foam insert for the back member comprises a plurality of selectively positionable vertebral support nodules for individual adjustment.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale.

DETAILED DESCRIPTION

Figure 1A:
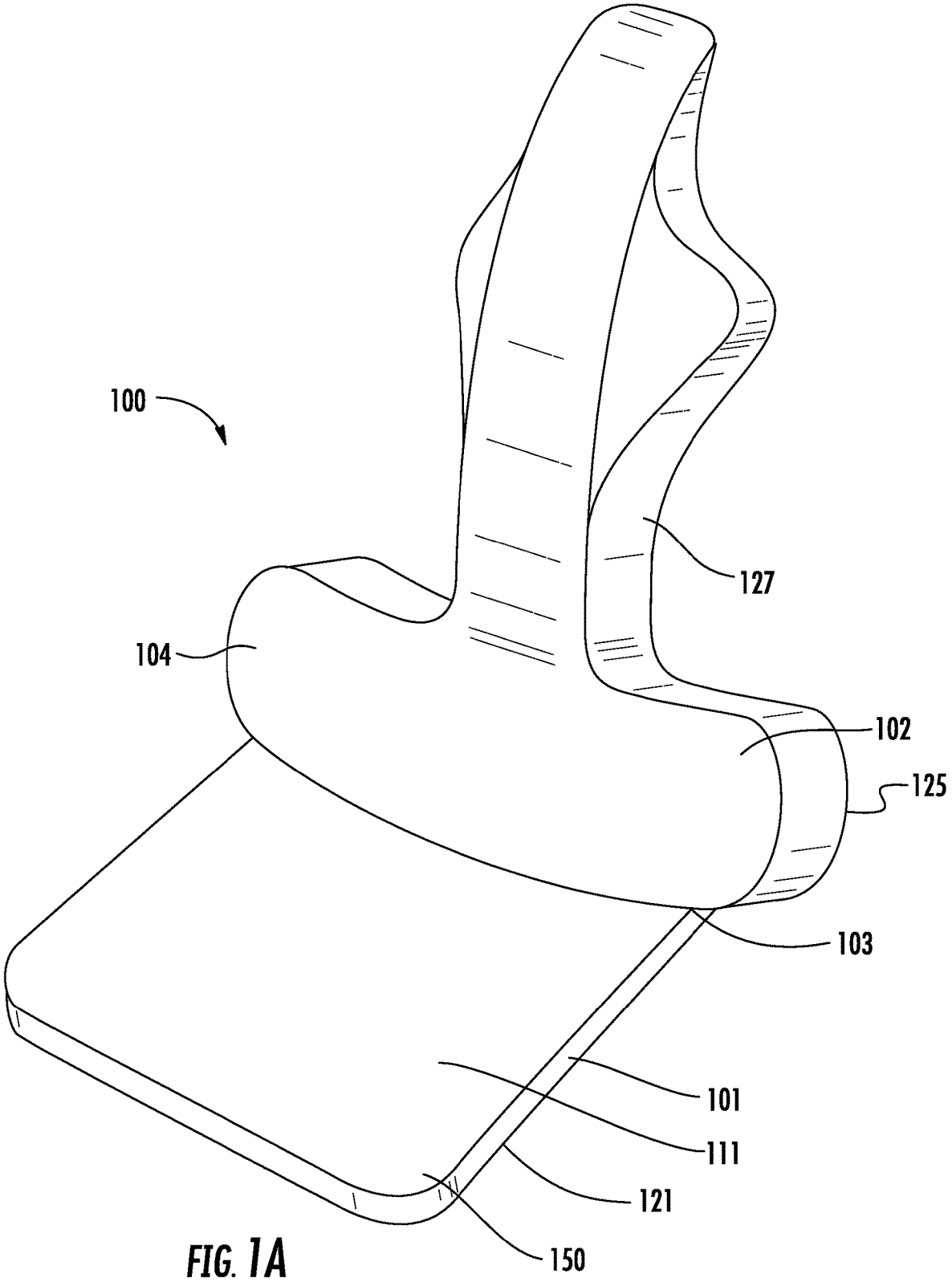
FIG. 1A is a perspective view of a seat and back cushion according to an embodiment of the present disclosure.

The present disclosure provides a portable cushion with individually customizable support for the pelvic, lumbar and thoracic regions to provide customized ergonomic support. In embodiments, the portable cushion is a portable seat and back cushion, which includes (i) a seat member which comprises an inflatable bladder or a foam insert; (ii) a back member foldably connected along an edge to the seat member; and (iii) a customizable spinal support member disposed within the back member, wherein the customizable spinal support member includes (a) an inflatable bladder which comprises a plurality of vertebral support bubbles arranged in vertical row about the middle of the back member, wherein an inflation pressure within each vertebral support bubble is individually adjustable; or (b) a semi-rigid insert which comprises a plurality of selectively positionable vertebral support nodules.

The seat cushion advantageously provides portability and customizable spinal support. The shape, position, and/or firmness of the customizable support member may be adjusted by a user according to his or her needs. Such customization allows for individual adjustments to support for pelvic, lumbar, and thoracic areas—including each individual vertebrae therein—that can be tailored to an individual user's pain or posture correction needs. The cushioning also may help users to mitigate aches and sores that result from prolonged periods of sitting.

The seat cushion includes a seat member and a back member. In a preferred embodiment, the seat member and back member are flexibly connected along an edge such that the seat member and the back member may be folded against one another. This folding functionality enables compact storage and transport of seat cushion. The seat and back members may connected by a number of different means. For example, the covers of the members may be in integrally connected (e.g., formed from a shared fabric material) or they may be joined together with straps, ties, zippers, hook-and-loop fasteners, or a combination thereof.

In embodiments, the back member contains a customizable spinal support member disposed therein. The customizable support member can take multiple forms, including an inflatable bladder with a plurality of vertebral support bubbles or a semi-rigid insert with support nodules. The firmness and/or position of the support bubbles and the support nodules can be individually adjusted to suit a user's needs.

In some embodiments, the seat member and the back member each includes a generally pliable outer cover in which the cushioning and support structures are contained. The covers may include a resealable opening for accessing compartments within the members for receiving the cushioning and support structures. The resealable opening may include one or more zippers, snaps, straps, hook-and-loop fasteners, or the like. In some embodiments, this cover may be formed of, or may include, a non-slip material, such as woven or non-woven fabrics (e.g., nylon), polymeric sheets (e.g., vinyl), or combinations of such materials as known in the art.

The seat member and back member may contain an inflatable bladder and/or foam insert for support and cushioning.

In some embodiments, the inflatable bladder contained within the back member includes a plurality of vertebral support bubbles arranged in a vertical row about the middle of the back member, approximately corresponding to the position of the spine of a person seated on the cushion. In some embodiments, the inflation pressure within each vertebral support bubble is individually adjustable. In some other embodiments, a subset of the support bubbles are sealed and unadjustable. In some embodiments, groups of the support bubbles, e.g., adjacent bubbles, are in fluid communication and share an inflation pressure. The inflatable bladder includes at least one valve configured for introducing and removing air from the inflatable bladder. Such valves are known in the art. In some embodiments, each bubble includes its own valve, so that each bubble can be inflated independently to its own pressure corresponding to a desired firmness for vertebral support.

In some embodiments, the inflatable bladder is positioned within the back member such that at least one of the vertebral support bubbles supports a pelvis and a sacrum. In some embodiments, at least one of the vertebral support bubbles also supports one or more vertebrae within the lumbar section of a human spine. In some embodiments, at least one of the vertebral support bubbles also supports one or more vertebrae within the thoracic section of a human spine.

In some other embodiments, instead of an inflatable bladder, a foam insert configured for vertebral support is provided for insertion within the back member. In preferred embodiments, the foam insert includes a plurality of vertebral support nodules affixed to the insert. The nodules may be removably affixable to an outer surface of the insert, so that the positions of the support nodules are adjustable and may be repeatedly repositionable to suit the particular support needs of a user. The support nodules may be secured to the insert with a pressure sensitive adhesive or a hood-and-loop fastener, for example. The support nodules may have a circular, elliptical, or semi-circular shape in a plan view, and in a cross-sectional view may have a spherical cap or other rounded outwardly projecting surface and an opposed substantially planar back surface that is securable to the foam insert. In some embodiments, the support nodule has a diameter from about 0.75 inches to about 1 inch, and a maximum thickness from about 0.25 inches to about 1 inch. In some embodiments, the foam insert has a Shore hardness ranging from Shore 00 20 to Shore D 40.

In the embodiment where the back member includes the semi-rigid insert, the insert and/or the vertebral support nodules may have a Shore hardness in a range from Shore 00 20 to Shore D 40. The semi-rigid insert may have a length of about 12 to 24 inches, with a width of about 0.5 to 2 inches, and a depth of about 1 to 12 inches. The dimensions of the semi-rigid insert may vary as necessary to provide appropriate support for pain relief and/or posture correction. These variations can include multiple curvature profiles of the semi-rigid insert such as an elliptical profile or a tapered profile.

The seat cushion may optionally include one or more straps or handles affixed to surfaces or edges that do not impede the user's comfort when sitting on the seat cushion. Such straps or handles may be configured to facilitate (i) securing the orientation between the seat member and the back member, (ii) securing the seat cushion onto chair or other seating surface in a useable position, (iii) storage and transport of the seat cushion, or (iv) a combination of any of (i) to (iii). In some preferred embodiments, the portable seat cushion is configured for relieving pressure points and improving posture through support of the pelvic, lumbar and thoracic regions, while maintaining a form that allows the cushion to be compatible with chairs and seats of varying shapes and sizes without specialized forms of seating and without the need for straps to secure the cushion to a seat or chair.

One non-limiting example of a seat cushion 100 according to the present disclosure is shown in FIG. 1A. The seat cushion 100 includes seat member 101 and back member 102, which are connected along edge 103. The seat member 101 and back member 102 may be foldable along this edge connection.

The seat member 101 has an upper surface 111 and an opposed lower surface 121 (which cannot be seen in FIG. 1A) for contacting a chair or other seating surface. The upper surface 111 and the lower surface 121 may be formed of the same material of construction, or they may be made of different materials of construction. For example, the lower surface may include a rubber, non-slip surface, and the upper surface may include a soft fabric for breathability and comfort. The seat member 101 includes a cover portion 150 and an inflatable bladder and/or a foam insert (not shown in this figure) disposed within the cover portion. The cover portion optionally may include an opening (not shown) having a resealable closure for inserting/removing the inflatable bladder and/or foam insert within the seat member.

The back member 102 includes a front surface 104 and contains an inflatable bladder or a foam insert (which cannot be seen in FIG. 1A). The covers forming the front surface 104 and the upper surface 111 may be formed of the same material of construction, or they may be made of different materials of construction. As shown in FIG. 1A, the back member has a wide base portion 125 and a narrower central portion 127 extending upwards from the wide base portion. In other embodiments, the central portion may be as wide as the base portion. In still other embodiments, the central and base portions can have a variety of shapes and relative sizes.

Figure 1B:
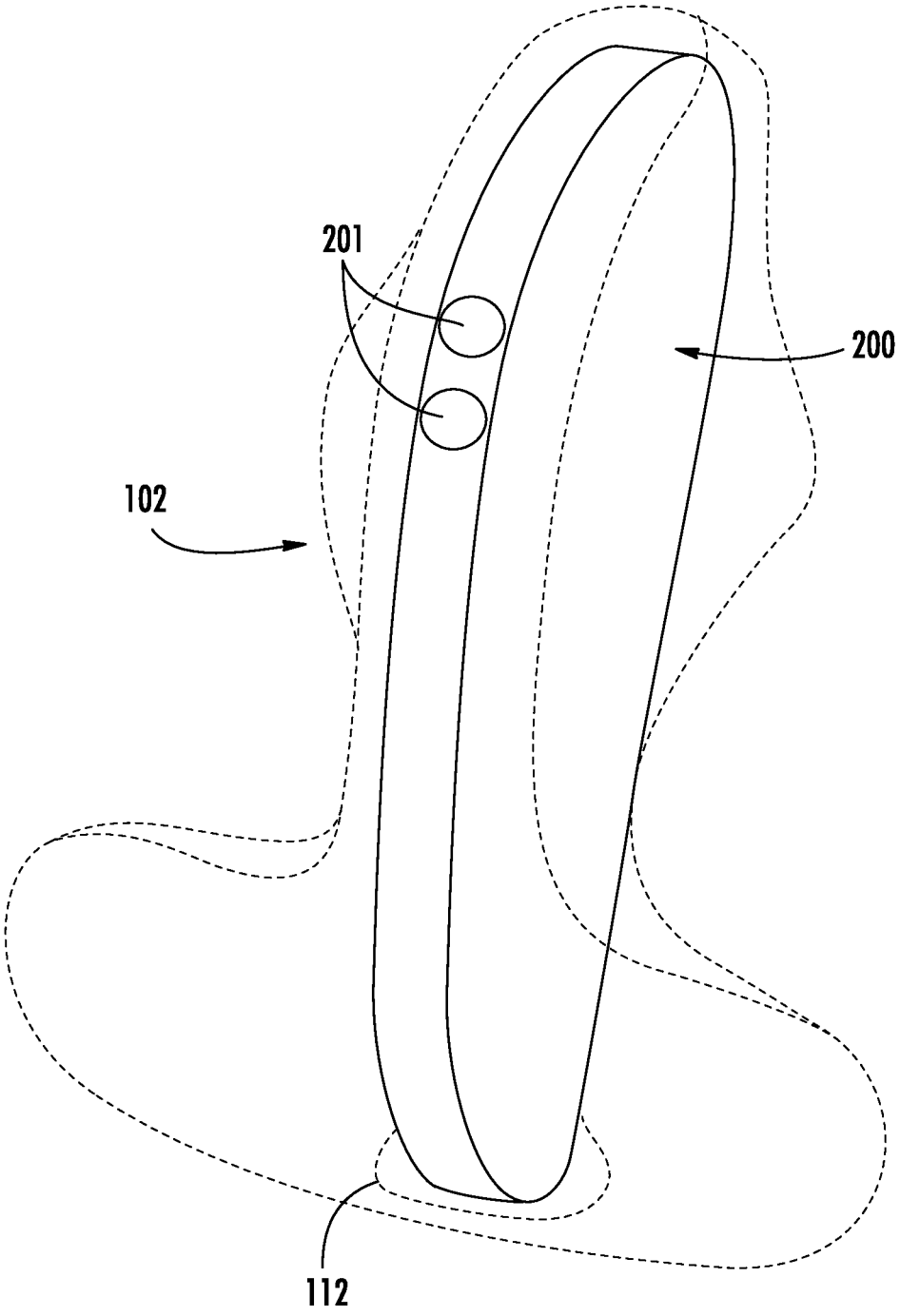
FIG. 1B is a perspective and partially transparent view of the back member of the seat and back cushion shown in FIG. 1A, showing how a semi-rigid insert or inflatable bladder may be disposed within the back member.

As shown in FIG. 1B, the back member 102 may include a semi-rigid insert 200 disposed within the back member 102. The back member 102 includes an opening 112 for accessing an interior space within the back member 102. The semi-rigid insert 200 can be inserted in this interior space and removed from this interior space through opening 112. The semi-rigid insert 200 has selectively positionable vertebral support nodules 201. Two support nodules are shown in FIG. 1B; however, any suitable number of vertebral support nodules 201 may be included at any suitable positions along insert 200.

Figure 2A:
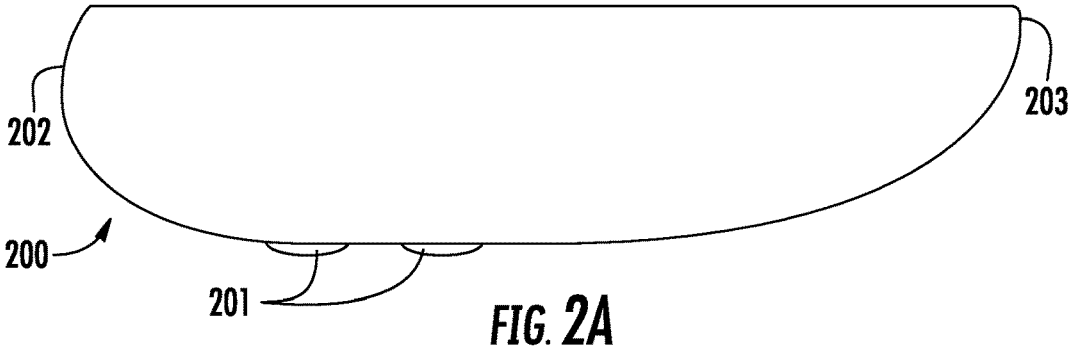
FIG. 2A is a side view of one embodiment of a semi-rigid insert according to an embodiment of the present disclosure.
Figure 2B:
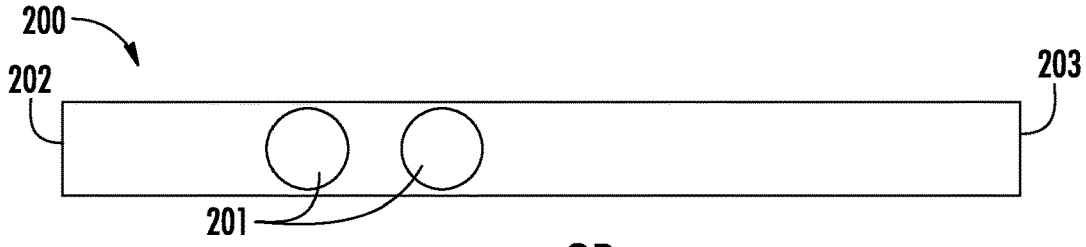
FIG. 2B is a plan view of one embodiment of the semi-rigid insert shown in FIG. 2A with vertebral support nodules attached.

FIGS. 2A-2B illustrate different views of one embodiment of the semi-rigid insert 200. The semi-rigid insert 200 has an elongated body extending from a proximal end 202 to an opposing distal end 203. In the illustrated embodiment, two vertebral support nodules 201 are attached to a front surface of the semi-rigid insert 200. In other embodiments, the additional support nodules may be included in spaced positions between the proximal and distal ends 202, 203. In a preferred embodiment, the length between the proximal and distal ends 202, 203 is between about 12 inches and about 24 inches. In a preferred embodiment, the width of the semi-rigid insert 200 in a direction perpendicular to an axis extending between the proximal and distal ends 202, 203 is between about 0.5 inches and about 2 inches.

Figure 2C:
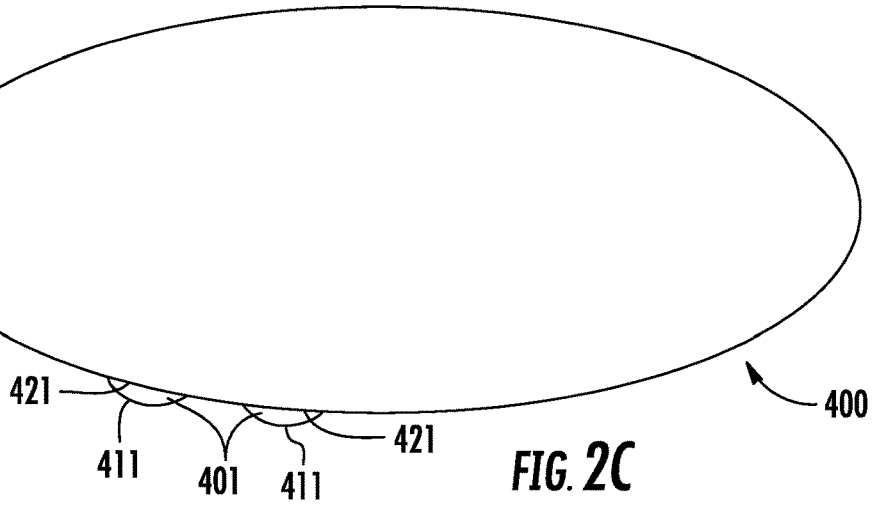
FIG. 2C is a side view of one embodiment of an elliptical semi-rigid insert, with vertebral support nodules attached, according to an embodiment of the present disclosure.

FIG. 2C illustrates one embodiment of an elliptical embodiment of a semi-rigid insert 400 with vertebral support nodules 401 which have a spherical segment shaped upper surface 411 and an opposed lower surface 421 secured to the insert 400.

Figure 2D:
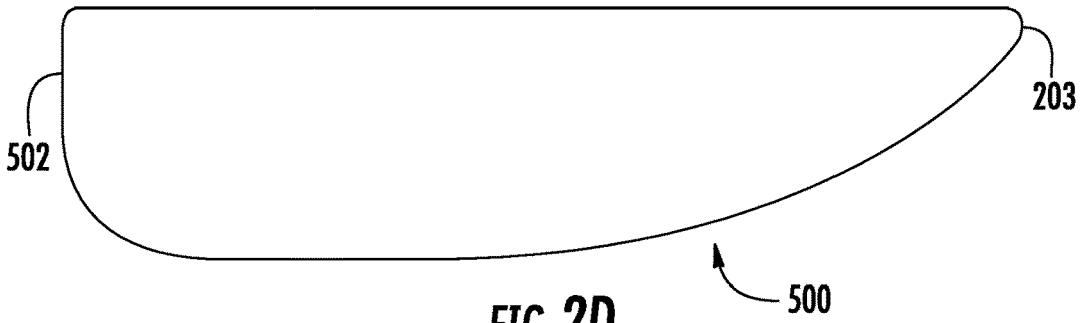
FIG. 2D is a side view of one embodiment of a tapered semi-rigid insert, according to an embodiment of the present disclosure.

FIG. 2D shows another embodiment of a semi-rigid insert 500 which has a tapered shape, tapering from proximal end 502 to distal end 503.

As noted above, in some embodiments, instead of the semi-rigid insert, the customizable spinal support member includes an inflatable bladder which includes a plurality of vertebral support bubbles arranged in vertical row about the middle of the back member. FIGS. 3A-3D illustrate non-limiting examples of such an embodiment.

Figure 3A:
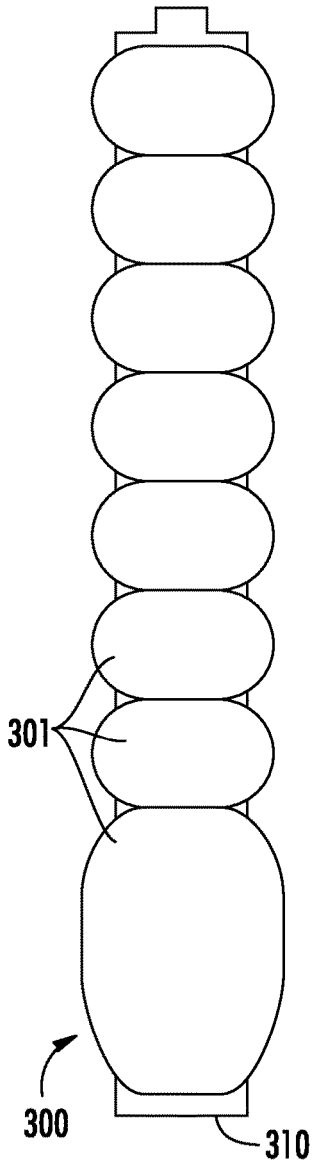
FIG. 3A is a plan view of an inflatable bladder insert with a plurality of vertebral support bubbles, according to an embodiment of the present disclosure.
Figure 3B:
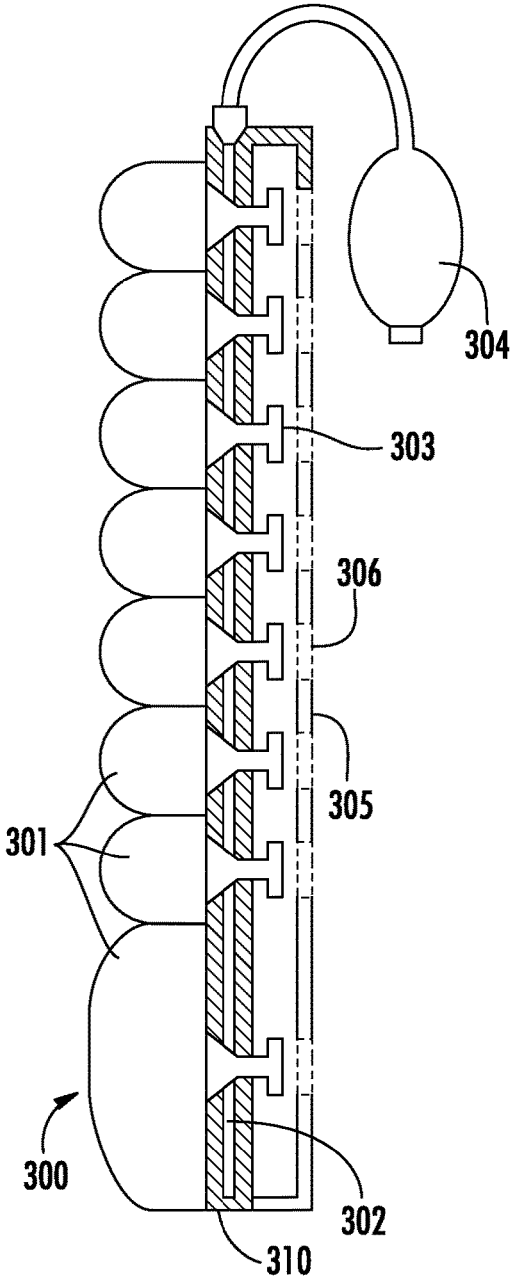
FIG. 3B is a cross-sectional view of the inflatable bladder insert shown in FIG. 3A with a plurality of vertebral support bubbles.
Figure 3C:
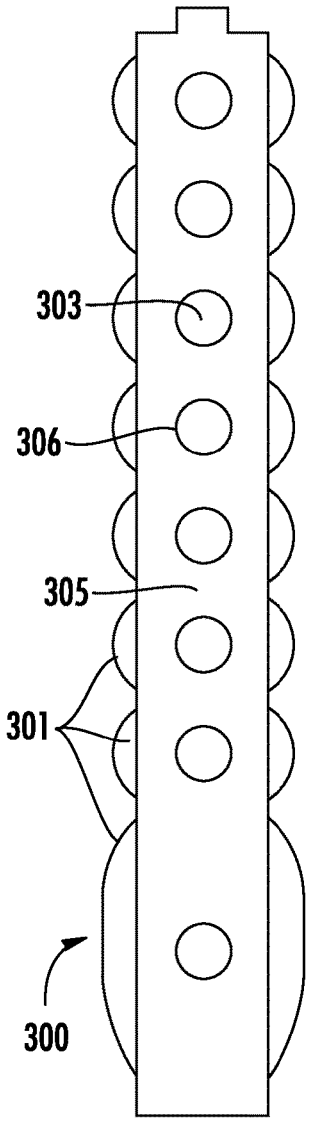
FIG. 3C is a back plan view of the inflatable bladder insert shown in FIG. 3A

FIG. 3A-3C show an inflatable bladder 300 with a plurality of vertebral support bubbles 301 arranged in vertical array on a main member 310. The main member 310 includes a manifold 302 and valves 303 which are configured to permit one to control the inflation pressure within each of the vertebral support bubbles 301. This feature allows for individual adjustment of the firmness of each of the vertebral support bubbles 301. The valves 303 govern the flow of gas between the manifold 302 and the vertebral support bubbles 301. The main member 310 further includes a valve cover plate 305 which includes valve access holes 306, each of which is aligned with exactly one of the valves 303 to permit a user to selectively depress the valve. However, the valve cover plate 305 is offset from the valves 303 to reduce the chance of accidental contact with and actuation of the valves 303.

In the illustrated embodiment of FIG. 3B, a manual air pump 304 is shown operably connected to the manifold 302. The pump may be permanently connected to the manifold, or it may be releasably connectable to the manifold. The vertebral support bubbles 301 may be made of a polymeric material (e.g., a silicone, a polyurethane, or another elastomer) or other suitable materials. The main member and manifold may be constructed of more rigid thermoplastic materials known in the art.

Figure 3D:
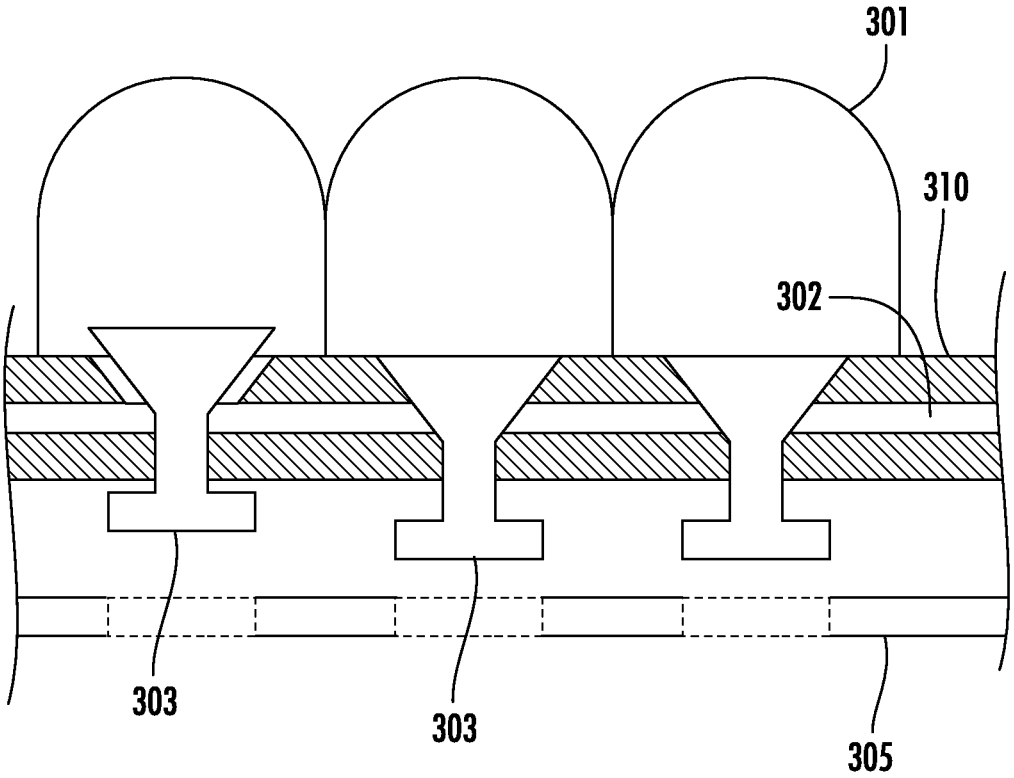
FIG. 3D is a cross-sectional view of the inflatable bladder insert shown in FIG. 3B, illustrating open and closed valve positions.

FIG. 3D shows two valves 303 with the one on the left being in an open position and the one on the right being in a closed position. In the open position, airflow between the vertebral support bubble 301 and manifold 302 is permitted. In the closed position, airflow between the manifold and the vertebral support bubble is blocked. A spring (e.g., a helical spring) (not shown) may be provided to bias the valve into the closed position.

Modifications and variations of the methods and devices described herein will be obvious to those skilled in the art from the foregoing detailed description. Such modifications and variations are intended to come within the scope of the appended claims.

What is claimed is:

1. A portable seat and back cushion for posture correction, comprising:

a seat member which comprises a foam insert;

a back member foldably connected along an edge to the seat member, the back member having:

a wide base portion, a narrower central portion extending upwards from the wide base portion, an elongated opening formed on the back member and extending along the wide base portion and the narrower central portion, the elongated opening enable accessing of an interior space formed within the back member; and a customizable spinal support member disposed within the interior space via the elongated opening of the back member, wherein the customizable spinal support member comprises:

a semi-rigid insert having an elongated body extending from a proximal end to an opposing distal end to compliment the elongated opening formed along the wide base portion and the narrower central portion, the semi-rigid insert to be accommodate within the interior space via the elongated opening, a plurality of selectively positionable vertebral support nodules attached to a front surface of the semi-rigid insert in spaced positions between the proximal and distal ends.

2. The portable seat and back cushion of claim 1, wherein the seat member defines an upper surface and a lower surface, and wherein one or both of the upper and lower surfaces comprises a non-slip material.

3. The portable seat and back cushion of claim 1, wherein the seat member comprises a foam insert with a shore hardness ranging from Shore D 20 to Shore D 40.

4. The portable seat and back cushion of claim 1, wherein the semi-rigid insert, and/or the nodules thereof, has a shore hardness in a range from Shore D 20 to Shore D 40.

5. The portable seat and back cushion of claim 1, wherein the semi-rigid insert is about 12 to 24 inches long and about 0.5 to 2 inches wide with a depth about 1 to 12 inches.

6. The portable seat and back cushion of claim 1, which comprises the semi-rigid insert and each of the nodules has a rounded upper surface and an opposed lower surface fixable to the insert.

7. The portable seat and back cushion of claim 6, wherein each of the nodules is substantially hemispherical with a diameter of about 0.75 to 1 inch wide and a maximum height of about 0.25 to 1 inch.

8. The portable seat and back cushion of claim 6, wherein the nodules comprise a pressure sensitive adhesive or a hook and loop fastener for securing the nodules.

9. The portable seat and back cushion of claim 1, wherein the semi-rigid insert is substantially elliptical.

10. The portable seat and back cushion of claim 1, wherein the semi-rigid insert tapers from a proximate end to a distal end.

* * * * *